United States Patent [19]

Boyatt, Jr. et al.

[11] 4,239,107

[45] Dec. 16, 1980

[54] CARTRIDGE ASSEMBLY APPARATUS FOR TYPEWRITERS

[75] Inventors: Richard G. Boyatt, Jr., Lexington; Donald J. Steger, Corinth, both of Ky.

[73] Assignee: International Business Machines Corporation, Armonk, N.Y.

[21] Appl. No.: 8,461

[22] Filed: Feb. 1, 1979

[51] Int. Cl.[3] ..... B65D 69/00

[52] U.S. Cl. ..... 206/225; 206/394; 220/23.86; 220/306; 400/208.1

[58] Field of Search ..... 400/207, 208, 208.1; 206/225, 393, 394; 220/23.6, 23.86, 306, 329, 334

[56] References Cited

U.S. PATENT DOCUMENTS

| | | | |
|---|---|---|---|
| 2,790,609 | 4/1959 | Hawthorne et al. | 220/23.6 |
| 3,260,344 | 7/1966 | Doyle | 220/334 |
| 3,272,304 | 9/1966 | Morelli | 400/208.1 |
| 3,425,531 | 2/1969 | Fuld | 400/208.1 |
| 3,673,987 | 7/1972 | Fletcher | 220/23.6 |

*Primary Examiner*—Joseph Man-Fu Moy

*Attorney, Agent, or Firm*—William J. Dick

[57] ABSTRACT

Disclosed is a ribbon tape cartridge assembly, the cartridges being adapted for mating in superimposed overlapping relation, bottom to bottom to form the assembly. Slots in tabs which project from the plane of one of the bottom surfaces of one of the cartridges coact with fins on the other of the cartridges, the fins movable into the slot for an interference fit with at least a portion of the tab. Shoulders on each of the cartridges also coact for limiting relative movement of the cartridges in a first direction with respect to each other. One of the cartridges is provided with a camming surface and a cam follower is provided the other of the cartridges, the cam and cam follower being engageable to effect relative movement between the cartridges in the first direction until the shoulders abutt one another inhibiting further relative motion. An additional slot in one of the cartridges is engageable with a projection on the other to further inhibit motion in a second direction perpendicular to the first direction, the cartridges being held together as by a latch so that when the cartridges are in superimposed overlapping relation, no relative movement may occur between the two cartridges.

17 Claims, 11 Drawing Figures

CARTRIDGE ASSEMBLY APPARATUS FOR TYPEWRITERS

SUMMARY OF THE INVENTION

The present invention relates to typewriter ribbon and erase tape cartridges which are connected together to form an assembly and more particularly relates to apparatus for securing a ribbon cartridge and erase tape cartridge together so as to act as a single rigid structure and yet be easily separated by the operator.

In U.S. patent application Ser. No. 801,286, filed May 27, 1977, by John O. Schaefer and owned by the assignee of this application, is disclosed a Cartridge Assembly For A Typewriter, the assembly including a ribbon cartridge to which is mated a severable and separate erase tape cartridge, the cartridge assembly being adapted for insertion and use in a typewriter. In the above identified application, the tape cartridge is severably connected to the ribbon cartridge as by pins and apertures. While such a connection is acceptable, multiple separation and reconnection or rejoining of the two cartridges together can result in the ability of one of the cartridges to move relative to the other cartridge. Moreover, with a simple projecting pin and aperture design for securing the ribbon cartridge to the erase cartridge, some difficulty in securing the one cartridge to the other does occur because of difficulty in aligning the pins on one of the cartridges with the apertures on the other cartridge.

In view of the above, it is a principle object of the present invention to provide apparatus for securing a ribbon cartridge and erase tape cartridge together so as to act as a single rigid structure (assembly) and yet be easily separable for replacement of one or the other of the cartridges forming the assembly.

Another object of the present invention is to provide novel apparatus for inhibiting any relative motion between joined together ribbon and erase tape cartridges when a simple latch is in place, but which, upon actuation of the latch, will permit the cartridges to pop apart thereby facilitating separation and replacement of one or other of the cartridges.

Other objects and a more complete understanding of the invention may be had by referring to the following specification and claims taken in conjunction with the accompanying drawings in which:

IN THE DRAWINGS

Figure 1:
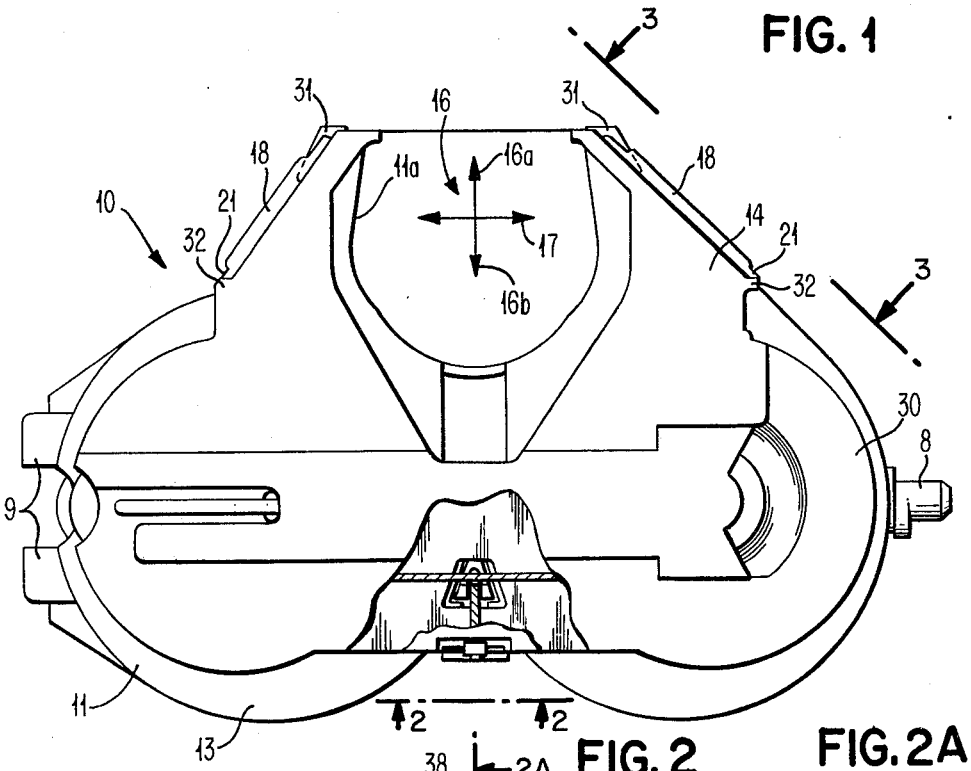
FIG. 1 is a fragmentary plan view of the bottom of a cartridge assembly connected together by apparatus constructed in accordance with the present invention.
Figure 2:
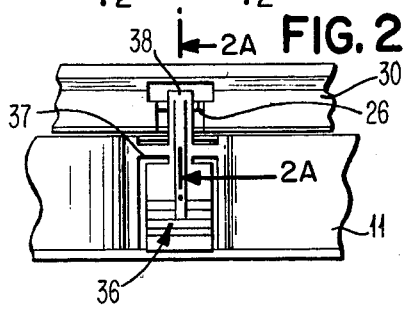
FIG. 2 is a fragmentary sectional view of a portion of the apparatus illustrated in FIG. 1 as viewed from line 2—2 of FIG. 1.
Figure 2A:
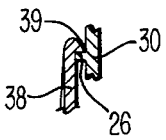
FIG. 2A is a fragmentary sectional view taken along line 2A—2A of FIG. 2.

Referring now to the drawings, and especially FIG. 1 thereof, a cartridge assembly 10 for use in typewriters and the like is illustrated therein. As shown, the assembly 10 comprises a ribbon cartridge 11, and an erase tape cartridge 30, the cartridges being positioned in superimposed overlapping relation to form the assembly 10, and releasably connected together by the apparatus constructed in accordance with the present invention. While the cartridges shapes or geometry are generally unimportant with regard to the apparatus of the present invention, it should be noted that the view of the assembly 10 illustrated in FIG. 1 is a view of the bottom of the assembly, the cartridge 11 being loaded with, for example typewriter ribbon, while the cartridge 30 may be loaded with erase tape and the like. The ribbon cartridge 11 has a top surface 12 and a bottom surface 13 while the erase cartridge 30 includes a top surface 14 and a bottom surface 15 (see FIG. 4), the bottom surface 15 of the erase cartridge 30 adapted to be mated face to face with the bottom surface 13 of the cartridge 11.

The purpose of the hinge means 9, the trunnion 8, and the coaction the drive of a typewriter with both the ribbon cartridge 11 and erase tape cartridge 30 for ribbon 7 and tape 6 advancement are the subject matter of co-pending patent application Ser. No. 801,286, filed on May 27, 1977 by John O. Schaefer and owned by the assignee of the present invention. However, it should be recognized that the apparatus of the present invention is suitable for any cartridge configuration as long as freedom from relative movement between the cartridges is desired.

In accordance with the invention, the ribbon and tape cartridges 11 and 30 respectively, are placed together in bottom to bottom relation and by the apparatus constructed in accordance with the invention are secured together so as to act as a single rigid structure or assembly and yet be easily separated as desired.

Figure 3:
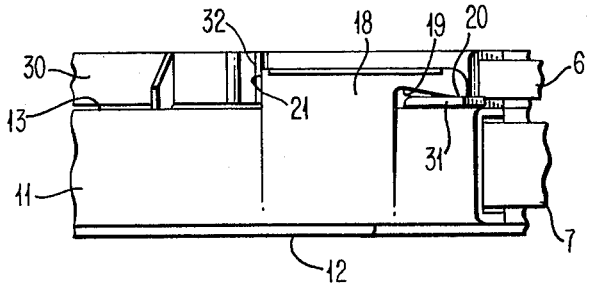
FIG. 3 is a fragmentary view of a portion of the apparatus illustrated in FIG. 1 and as viewed along line 3—3.
Figure 4A:
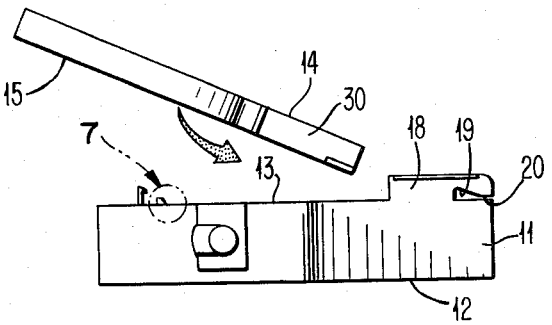
FIGS. 4A-4C are sequential diagrams illustrating how the cartridges are placed together to form a substantially rigid cartridge assembly.
Figure 4B:
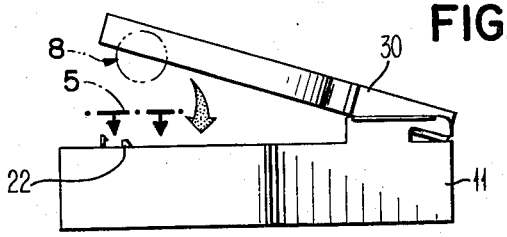

To this end, the apparatus cooperates so as to inhibit relative movement of the cartridges in either a first direction 16 or second direction 17. As illustrated best in FIGS. 3 and 4, one of the cartridges, in the present instance, the ribbon cartridge 11, includes tab means 18 which project from the plane of the bottom surface 13 so as to embrace, on opposite sides of the opening 11*a* associated with the ribbon and tape cartridges 11 and 30, a portion of the tape cartridge 30. As illustrated, the tab means form a pair of spaced apart converging and upstanding members which tend to embrace the side walls of the forward portion of the cartridge 30. As shown in FIGS. 3 and 4, the tab means 18 includes means defining a slot 19 therein, the slot being generally tear shaped in design having a narrow opening 20 for reasons which will be more clearly understood hereinafter. The other of the cartridges, in the illustrated instance the erase cartridge 30, includes fin means 31 thereon which are movable into the slot 19 for engagement with at least a portion of the means defining the slot, as at the narrowed portion 20 of the slot. In essence, the fit between the fin means 31 on either side of the opening 11*a* associated with the cartridges and the associated slots 19 formed in the tab means 18 is essentially an interference fit which serves to press down a portion of one of the cartridges against the other of the cartridges so as to hold the same together, at least at the forward end portions adjacent the openings 11*a* of the cartridges.

As illustrated in FIG. 1, the direction arrow 16 has two arrowheads labelled 16*a* and 16*b*. In order to limit the relative movement of said cartridges in a first direction, for example in the direction 16*a* (erase cartridge 30 with respect to ribbon cartridge 11), mutually engageable means on the cartridges limit the relative movement of the cartridges in the first direction 16*a* with respect to each other. To this end, the mutually engageable means on the cartridges comprises first shoulders 32 which project from opposite sides of the periphery of the cartridge 30 which engage second shoulders 21, in the present instance the rearward terminal edges of the tab means 18. Thus when the shoulders 32 engage the shoulders 21, further movement forward of the cartridge 30 against the shoulder 21 is inhibited thereby preventing motion of the cartridge 30 relative to the cartridge 11 in the direction 16*a*.

Figure 7:
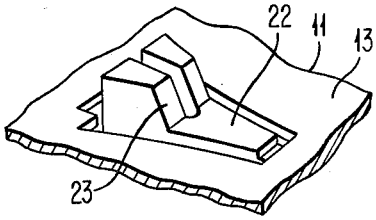
FIG. 7 is an enlarged fragmentary perspective view of the solid line portion of the apparatus illustrated in FIG. 5 and as viewed in the dotted line portion illustrated in FIG. 4A.
Figure 8:
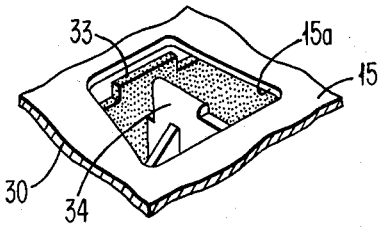
FIG. 8 is an enlarged fragmentary perspective view of the coacting portion of the apparatus on one of the cartridges which mates with the apparatus illustrated in FIG. 7 and as best shown in FIG. 6.
Figure 5:
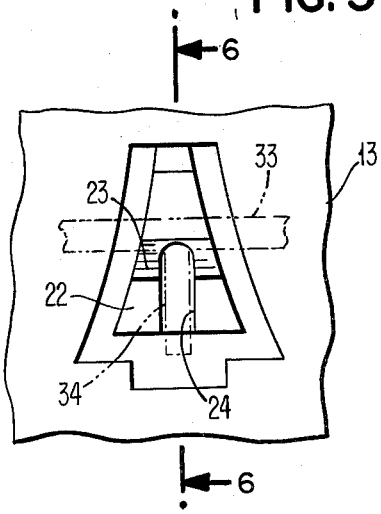
FIG. 5 is an enlarged fragmentary view in plan illustrating in solid lines a portion of the apparatus contained in one of the cartridges and as viewed along line 5—5 of FIG. 4B and in dotted lines the coaction of a portion of the apparatus contained in the other of the cartridges.
Figure 6:
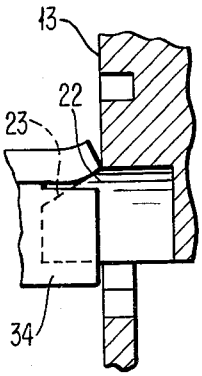
FIG. 6 is a fragmentary sectional view showing the coaction of the dotted line portion of the apparatus illustrated in FIG. 5 in solid lines as to its mating with the solid lined portion of the structure illustrated in FIG. 5.

In order to inhibit motion of the cartridge 30 relative to the cartridge 11 in the direction 16*b* (opposite 16*a*), while helping to force the shoulders 32 against the shoulders 21, a camming surface on one of the cartridges and a cam follower on the other of the cartridges engage to effect relative movement between the cartridges in the first direction (16*a*) until the mutually engageable means inhibit further relative motion. To this end, and referring first to FIGS. 5, 6 and 7 in the present instance the cartridge 11 is provided with a cam and catch means 22 which projects from the bottom surface 13 of the cartridge 11. The cam and catch 22 includes a camming surface 23 (FIG. 7) which is adapted to receive a cam follower 33 (FIG. 8) connected to the cartridge 30 and specifically lying within an opening 15*a* in the bottom 15 of the cartridge 30, the opening 15*a* adapted to align with the cam and catch 22. As illustrated best in FIG. 6, the cam follower 33 upon striking the camming surface 23 will tend to move the cartridge 30 forward until the mutually engageable means, i.e., the shoulders 32 abutt the shoulders 21 on the respective cartridges 30 and 11. Thus the cam follower 33 serves to effect advancement of the cartridge 30 in the direction 16*a* until a solid engagement is effected between the shoulders 32 on the cartridge 30 and the shoulders 21 on the cartridge 11. Preferably, the cam follower 33 is composed of a resilient material which causes the follower to deflect as best illustrated in FIG. 6, until the bottom surfaces 13 and 15 of the cartridges 11 and 30 are in bottom to bottom relation such as illustrated schematically in FIG. 4C. Moreover, the action of the cam follower 33 against the camming surface prevents movement of the cartridge 30 relative to the cartridge 11 in the direction 16*b*.

In order to inhibit motion of the cartridge 30 relative to the cartridge 11 in the direction of the arrow 17, cooperating means are provided on the cartridges to limit relative motion between the cartridges in the second direction perpendicular to the first direction. To this end, the cooperating means comprises a slot 24 in the cam and catch 22, the slot extending forwardly through the camming surface 23, and being dimensioned to receive a member 34 which is substantially perpendicular to the cam follower 33 and adjacent thereto. In this manner, the member 34 may enter the slot 24 and thereby inhibit lateral movement of the after end of the cartridge 30 relative to the cartridge 11, the cooperation of the fins 31 and tabs 18 (slots 19 and interference fit of the tab and fins as at 20) preventing lateral movement of the cartridge 30 relative to the cartridge 11.

Figure 4C:
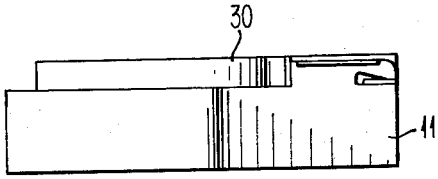

In order to retain the cartridges together in the position shown in FIGS. 1, 3 and 4C, a simple latch means 36 may be incorporated. In the illustrated instance the latch may including a tenon 37 which forms a part of the outer portion of the cartridge 11, and includes an upstanding member 38 including a hook 39 which engages a web or catch portion 26 on the cartridge 30. The catch 26 and hook 39 are arranged as shown because the cam follower 33, when the cartridges 11 and 30 are placed in mating relation, assumes the position illustrated in FIG. 6 causing a biasing action which tends to separate the cartridges. Thus the catch 26 and hook 39 are positioned so that the member 38 is in tension. In this manner, upon depressing the handle portion of the latch 36, and removal of the hook 39 from the catch portion 26 effects a popping apart of the cartridges 30 and 11 due to the biasing action and deformation of the cam follower 33. In this manner, the cartridges of the present invention are placed together and held in place while relative motion between the cartridges is inhibited.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. A cartridge assembly for a typewriter, said cartridge assembly comprising in combination:

a ribbon cartridge and a tape cartridge adapted for mating in superimposed overlapping relation to form said cartridge assembly;

each of said cartridges having top and bottom surfaces, said bottom surfaces being positioned, when forming said cartridge assembly, in bottom to bottom relation;

tab means projecting from the plane of one of said bottom surfaces of one of said cartridges, and means defining a slot in said tab means;

fin means on the other of said cartridges and movable into said slot for engagement with at least a portion of said means defining said slot;

mutually engageable means on said cartridges for limiting relative movement of said cartridges in a first direction and with respect to each other;

a camming surface on one of said cartridges and a cam follower on the other of said cartridges, said camming surface and cam follower engageable to effect relative movement between said cartridges in said first direction until said mutually engageable means inhibit further relative motion;

cooperating means on said cartridges to limit relative motion between said cartridges in a second direction perpendicular to said first direction, and latch means to hold said cartridges in superimposed overlapping relation.

2. A cartridge assembly in accordance with claim 1 wherein said tab means comprised a pair of spaced apart converging and upstanding members which embrace at least a portion of the other of said cartridges.

3. A cartridge assembly in acccordance with claim 2 wherein said slot in said tab means is tear shaped, and said portion of said means defining said slot being in engagement with said fin means being the narrowest portion of said tear shaped slot.

4. A cartridge assembly in accordance with claim 3 wherein said fin means and said narrowest portion of said tear shaped slot form an interference fit.

5. A cartridge assembly in accordance with claim 1 wherein said mutually engageable means comprises mutually abutting shoulders on said cartridges.

6. A cartridge assembly in accordance with claim 5 wherein said shoulders are spaced apart, on the periphery of one cartridge and abut like shoulders on the other of said cartridges.

7. A cartridge assembly in accordance with claim 6 wherein said like shoulders on the other of said cartridges are on said tab means.

8. A cartridge assembly in accordance with claim 1 including a cam and catch means projecting from the plane of one of the bottom surfaces of one of said cartridges, said cam and catch means including said camming surface.

9. A cartridge assembly in accordance with claim 8 wherein said cam follower is resilient and is biased upon said cartridges being brought together whereby upon release of said latch means, separation of said cartridges is facilitated.

10. A cartridge assembly in accordance with claim 1 wherein said cooperating means comprises, means defining a slot in one of said cartridges and a projection in the other of said cartridges, said projection and slot being dimensioned and positioned for coactive engagement when said cartridges are in mating relation with each other.

11. A cartridge assembly in accordance with claim 10 wherein said slot lies in said first direction.

12. A cartridge assembly in accordance with claim 10 including cam and catch means projecting from the plane of one of the bottom surfaces of one of said cartridges and including said camming surface thereon, said slot being formed in said cam and catch means.

13. A cartridge assembly in accordance with claim 12 wherein said slot lies substantially perpendicular to said camming surface.

14. A cartridge assembly for a typewriter, said cartridge assembly comprising in combination:

a ribbon cartridge and a tape cartridge adapted for mating in superimposed overlapping relation to form said cartridge assembly;

each of said cartridges having top and bottom surfaces, said bottom surfaces being positioned, when forming said cartridge assembly, in bottom to bottom relation;

a pair of spaced apart tabs projecting from the plane of one of said bottom surfaces of one of said cartridges, and means defining a slot in each of said tabs;

a pair of radially projecting fins on the other of said cartridges dimensioned for movement into said slots for engagement with at least a portion of said means defining said slot;

mutually engageable shoulders on said cartridges for limiting relative movement of said cartridges in a first direction and with respect to each other;

a cam having a camming surface thereon on one of said cartridges and a cam follower on the other of said cartridges, said cam and cam follower engageable to effect relative movement between said cartridges in said first direction until said mutually engageable shoulders inhibit further relative motion;

a cooperating slot member and projection member, one of said members on one of said cartridges and the other of said members on the other of said cartridges to limit relative motion between said cartridges in a second direction perpendicular to said first direction, and a latch to hold said cartridges together in superimposed overlapping relation.

15. A cartridge assembly in accordance with claim 14 wherein said tabs project perpendicularly from the plane of said bottom surface of said one cartridge and lie in converging planes.

16. A cartridge assembly in accordance with claim 15 wherein said slots in said tabs are tear shaped, and the narrowest portion of each of said slots and each of said fins form an interference fit.

17. A cartridge assembly in accordance with claim 16 wherein said cam follower is resilient and becomes biased upon said cartridges being brought together whereby, upon release of said latch means, the biasing action of said cam follower against said camming surface, causes said cartridges to pop apart.

* * * * *